US006063193A

United States Patent [19]

Hess et al.

[11] Patent Number: 6,063,193

[45] Date of Patent: May 16, 2000

[54] APPLICATOR FOR DIRECT OR INDIRECT APPLICATION OF A LIQUID OR PASTY MEDIUM ONTO A TRAVELING FIBER MATERIAL WEB

[75] Inventors: Harald Hess, Grünkraut; Zygmunt Madrzak, Heidenheim, both of Germany

[73] Assignee: Voith Sulzer Papiermaschinen GmbH, Heidenheim, Germany

[21] Appl. No.: 08/984,653

[22] Filed: Dec. 3, 1997

[30] Foreign Application Priority Data

Dec. 12, 1996 [DE] Germany ..... 196 51 738

[51] Int. Cl.[7] ..... B05C 3/02

[52] U.S. Cl. ..... 118/410; 118/123; 118/324; 118/413; 118/419; 118/DIG. 4; 156/578

[58] Field of Search ..... 118/410, 324, 118/DIG. 4, 413, 419, 123; 156/578; 222/481, 482, 547; 427/420

[56] References Cited

U.S. PATENT DOCUMENTS

| | | | |
|---|---|---|---|
| 4,930,437 | 6/1990 | Eckhard | 118/410 |
| 4,934,310 | 6/1990 | Wöhrle et al. | 118/410 |
| 5,436,030 | 7/1995 | Damrau | 427/240 |
| 5,858,096 | 1/1999 | Madrzak et al. | 118/410 |

FOREIGN PATENT DOCUMENTS

| | | |
|---|---|---|
| 0 041 729 | 12/1981 | European Pat. Off. . |
| 0 701 022 A2 | 3/1996 | European Pat. Off. . |
| 0 761 877 A2 | 3/1997 | European Pat. Off. . |
| 44 32 177 A1 | 3/1996 | Germany . |
| 44 32 178 | 3/1996 | Germany . |
| 44 32 180 A1 | 3/1996 | Germany . |
| 295 20 678 | 7/1996 | Germany . |
| 195 14 772 | 10/1996 | Germany . |
| 195 14 772 A1 | 10/1996 | Germany . |
| 2019916 | 11/1979 | United Kingdom . |

*Primary Examiner*—Deborah Jones
*Assistant Examiner*—Robert R. Koehler
*Attorney, Agent, or Firm*—Taylor & Aust, P.C.

[57] ABSTRACT

An applicator for direct or indirect application of a liquid or pasty medium onto a traveling fiber material web includes a metering slot formed as open-jet nozzle between an approach-side lip and a departure-side lip. The approach-side lip or the departure-side lip features on its end directed toward the fiber web an angled flow guide surface.

9 Claims, 3 Drawing Sheets

APPLICATOR FOR DIRECT OR INDIRECT APPLICATION OF A LIQUID OR PASTY MEDIUM ONTO A TRAVELING FIBER MATERIAL WEB

BACKGROUND OF THE INVENTION

1. Field of the Invention

The present invention relates to an applicator for direct or indirect application of a liquid or pasty medium onto a traveling fiber material web.

2. Description of the Related Art

In the case of direct application, the applied medium is transferred directly onto the traveling fiber material web, notably of paper or cardboard. In indirect application, the applied medium is first transferred to an applicator roll, which in turn transfers the applied coating medium onto the fiber material web.

There are prior applicators wherein two lips form between themselves a metering slot which acts as an open-jet nozzle. The metering slot is also called a color discharge slot. Such an applicator can be described as an open-jet nozzle applicator or "Fountain Applicator" (JetFlow F), due to the formation of an open jet of the liquid or pasty medium proceeding through the ambient atmosphere. The liquid or pasty medium is applied by the open jet directly or indirectly onto the traveling material web.

In general, in this applicator the liquid or pasty medium is fed via a color manifold which is arranged within a support beam extending across the width of the applicator (or the width of the web being coated). The medium proceeds from the color manifold via conduits in an equalization space and flows from there via a feed conduit to the metering slot, from which the liquid or pasty medium subsequently exits in the form of the "open jet." In the direct application of the medium, a material web passes by the open-jet nozzle and is acted upon, as described above, directly with the open jet of the liquid or pasty medium. The material web can in the process be carried, for example, on the surface of a roll. In the indirect application of the medium, the open jet is applied first on a substrate, e.g., the surface of an applicator roll, and transfers from the applicator roll to the material web in a nip through which the material web passes.

Of the two lips forming the metering slot, the one disposed on the side of the metering slot on which the fiber web approaches the applicator is termed the approach-side lip. Accordingly, the second lip, disposed on the side of the metering slot on which the fiber web departs from the applicator, is termed the departure-side lip.

The open-jet nozzle applicator is usually followed by a final metering system which by use of a doctor element, e.g., a doctor blade, scrapes the applied liquid or pasty medium down to the desired amount of application. Arranged between the departure-side lip of the applicator and the final metering system, furthermore, is a collection trough serving to collect surplus liquid or pasty medium draining from the applicator or from the final metering system.

Such an open-jet applicator is known, for example, from U.S. Pat. No. 5,436,030 or DE 44 32 177A1.

SUMMARY OF THE INVENTION

The present invention creates an applicator which in an easy and effective manner allows a better smoothing of the color quantity across the entire web width.

The relatively sharp break in the flow guide surface results in a centrifugal force with pressure loss, by impulses, so strong that the flow of the liquid or pasty medium is surprisingly smoothed across the entire web width, better than heretofore. That is, a better coating cross profile (microprofile without striation) is achieved.

Besides, the inventional flow guide surface—angled toward the flowing medium or toward the direction of travel of the surface being coated—occasions an appreciably better ventilation of the coating medium (ventilation of air entrained in the approach of the traveling surface).

The invention allows very suitable use in open-jet and other applicators wherein the metering slot is fashioned as an open-jet nozzle that is divided across the length of the applicator in the manner of a comb, according German patent applications 195 49085.1 and 195 32920.1 assigned to the assignee of the present invention. According to these applications, the comb-type subdivision may be machined directly into the approach-side and/or departure-side lip. According to the applications, however, a profile bar arranged in the metering slot or the approach-side and/or departure-side lip may also be present, with a plurality of defined through slots.

Owing to its particular geometry, the metering slot or the profile bar features a plurality of defined through slots for the liquid or pasty medium. This makes it possible to provide a large number of very exact conduits for the liquid or pasty medium. The conduits or through slots of either the metering slot, which is subdivided in comb fashion, or of the profile bar act as an open-jet nozzle from which the liquid or pasty medium discharges in the form of an open jet.

When using specific coating mediums it might occur in practice that the coating medium, while distributed evenly across the web, nonetheless displays minutest striae corresponding to the geometry of the through slots described above. Therefore, the applicator according to the invention also allows with this variant an easily performed smoothing of the liquid or pasty medium across the entire web width. Besides, the inventional applicator allows a distinctly reduced loading of a final metering doctor, which facultatively follows, on account of the smooth coating quantity across the entire web width.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
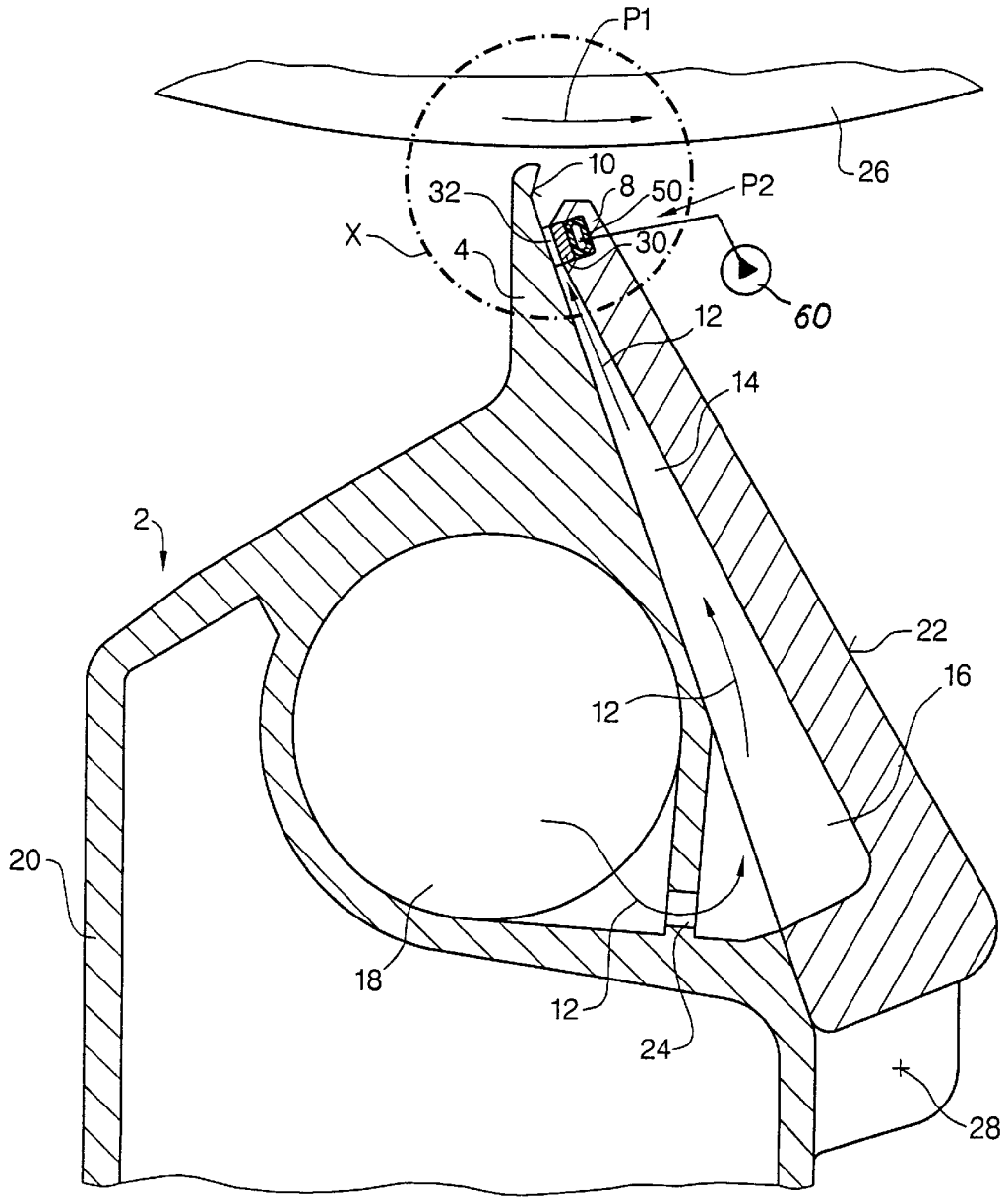
FIG. 1 is a schematic, side cross-sectional illustration of a first embodiment of the inventional applicator.

Referring now to the drawings and particularly to FIG. 1, there is shown a schematic cross-sectional illustration of a first embodiment of the inventional applicator 2 including a beam 20 that extends across the entire width of the applicator (in the width direction of the paper web). The beam 20 houses a manifold 18, usually described as a color manifold, for the liquid or pasty medium to be applied. Bordering manifold 18 and connected via conduits 24 is an equalization space 16 that extends into a feed conduit 14. The feed conduit 14 empties in a metering slot configured as an open-jet nozzle, the metering slot being formed between an approach-side lip 4 and departure-side lip 8. The design of feed conduit 14 is such that it tapers steadily toward the metering slot. The latter itself is in this embodiment subdivided in comb fashion and possesses a plurality of defined through slots 32 for the liquid or pasty medium. A profile bar 30 serves in the present embodiment as such a metering slot. The approach-side lip 4 and/or departure-side lip 8 includes a comb-like like slot profile, or profile bar 30, forming through slots 32. The profile bar 30 has been described already in German patent application 195 32920.1 and German patent application 195 49085.1 assigned to the assignee of the present invention.

The profile bar 30 is arranged here on the departure-side lip 8 and extends substantially across the entire width of a rotating roll 26. The profile bar 30 according to this form of embodiment has substantially rectangular cross section and is retained one-sidedly in a recess contained in the upper region of departure-side lip 8 and serving as a hold-down.

The depth of the recess is greater than the depth of profile bar 30, making profile bar 30 movable in its holding device in a direction toward approach-side lip 4, marked in the figure by arrow P2, substantially transverse to the plane of flow of the liquid or pasty medium 12 flowing in feed conduit 14. Provided between the bottom of the recess and the back side of profile bar 30 is a hold-down which forces profile bar 30 directly or indirectly, transverse to the plane of flow of liquid or pasty medium 12 flowing in feed conduit 14, in the direction P2 toward approach-side lip 4. This hold-down is configured as a hose-like element 50 which deforms under the effect of a working medium, such as compressed air, thus moving profile bar 30 by direct force effect in the aforementioned direction P2. Also provided for that purpose is a pressure-generating system 60, illustrated in the drawing (FIG. 1), which imparts a suitable pressure to the working medium in hose-like element 50.

Figure 2:
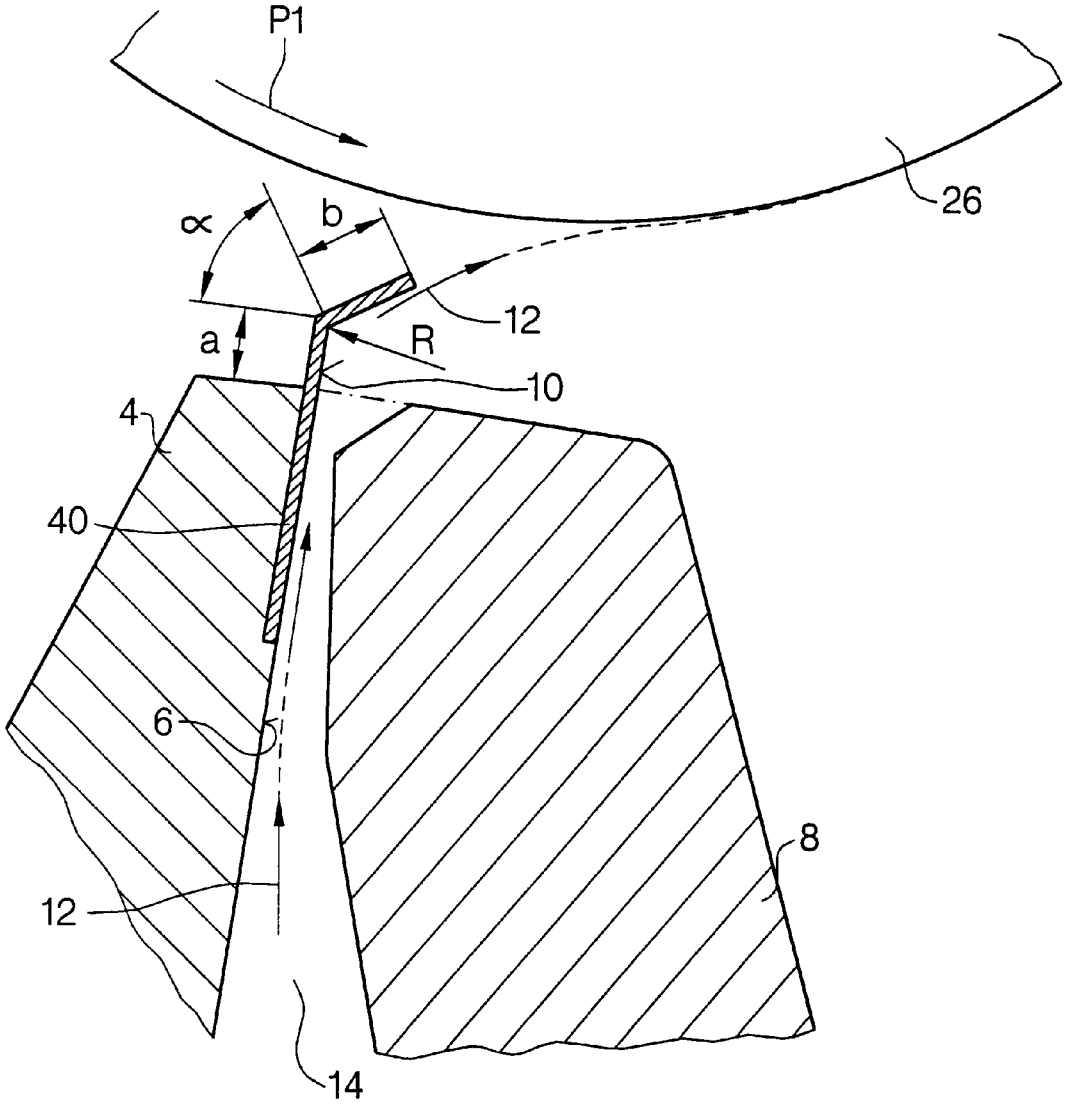
FIG. 2 is a scaled up, schematic illustration of a second embodiment of the area X in FIG. 1.

Forming on the top, free end of the approach-side lip 4, which extends beyond the free end of the departure-side lip 8, is a flow guide surface 10 bent at an angle $\alpha$ (FIG. 2). The liquid or pasty medium and its flow direction are indicated by arrows 12.

Disposed opposite applicator 2 is rotating roll 26, which may be an applicator roll for indirect application of the medium or may be a backing roll carrying a traveling fiber material web of paper or cardboard. The direction of rotation of rotating roll 26 is identified by arrow P1.

For the sake of completeness it should be mentioned yet that a front wall 22, to which the departure-side lip 8 is fixedly joined, is operationally fixed rigidly. As needed, however, for example for cleaning purposes, it can be turn ed down about a joint 28. The back side of front wall 22, i.e., the side away from feed conduit 14, is configured as a run-off surface for surplus liquid or pasty medium.

In this applicator 2 according to FIG. 1, the liquid or pasty medium 12 passes first through color manifold 18, proceeds then in equalizing space 16 and flows through feed conduit 14 to through slots 32 of profile bar 30, from which slots the medium then exits in the form of a not illustrated open jet. To facilitate the flow, through slots 32 extend substantially parallel to the flow direction of coating medium 12 flowing in feed conduit 14. The sharply angled guide or deflection surface 10 of approach-side lip 4 deflects the application jet toward rotating roll 26.

The liquid or pasty medium 12 transfers in the form of the open jet onto traveling surface 26 and can then be scraped down for adjustment to a desired amount of application, in a not illustrated subsequent final metering system.

In another embodiment (not shown), the applicator is equipped with an adjustment system for approach-side lip 4 or departure-side lip 8.

Visible in FIG. 2, which shows a schematically scaled up illustration of the area X in FIG. 1, are details according to yet another embodiment. The profile bar 30 of FIG. 1 is not illustrated here, since its presence is not mandatory.

FIG. 2 shows more distinctly the flow guide surface 10. A guide element 40, with its shanks a and b, forms here the flow guide surface 10. Shank b projects from shank a at an angle $\alpha$ relative to shank a which may range between 10° and 70° (in the illustrated example 45° ). The flow guide surface 10 is sharp-edged or angled with a small radius R of up to 9 millimeters. In one embodiment, radius R is approximately between 0.5 and 3 millimeters.

The areas a and b have approximately the same length, the shank a being measured from the end of the approach-side lip 4 disposed approximately at the same level as the departure-side lip 8.

The rigidity of such a guide plate according to FIG. 2 is high. Besides, the fabricating cost for such a guide surface would seem to be lower than for that illustrated in FIG. 1, machined directly in nozzle lip 4.

Figure 3:
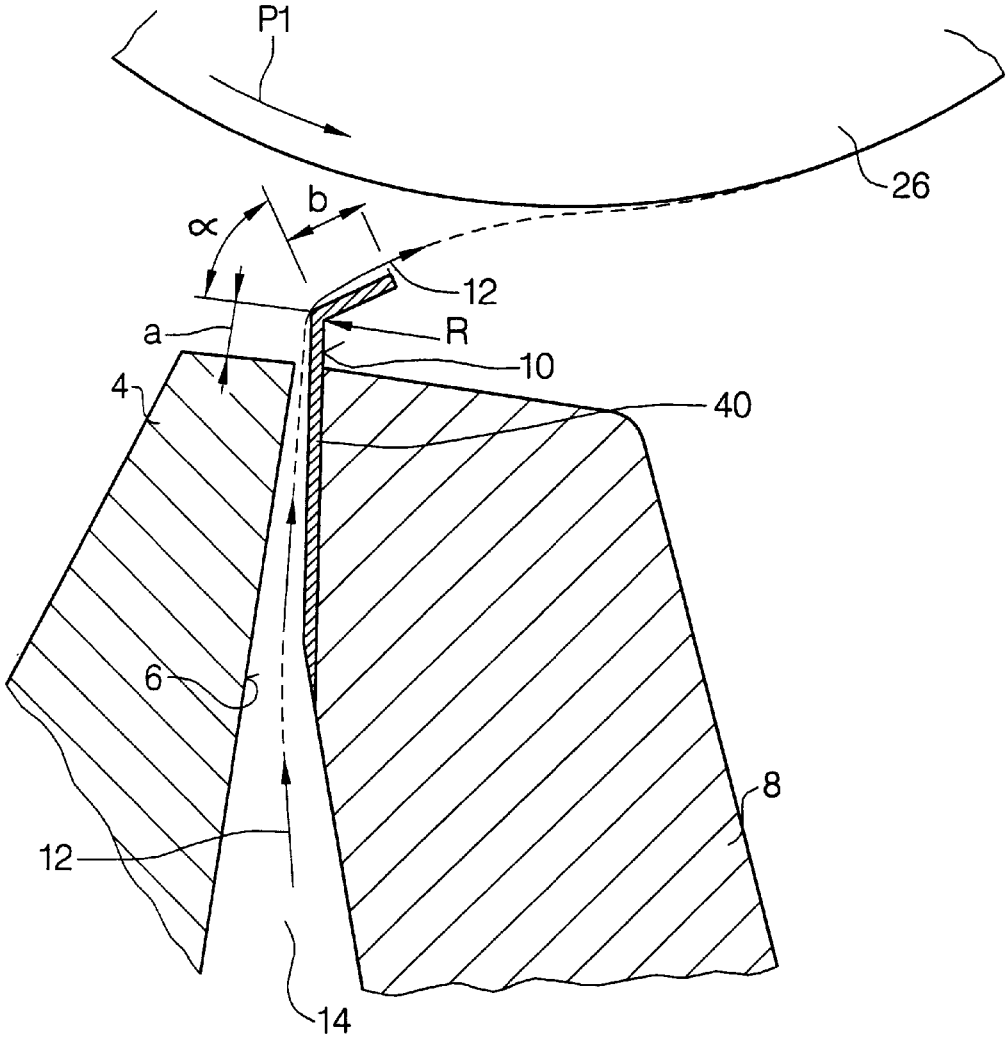
FIG. 3 is a scaled up, schematic illustration of a third embodiment of the area X.

The embodiments illustrated in conjunction with FIGS. 1 and 2 merely represent examples. In the framework of the invention, of course, the flow guide surface 10 or guide element 40 can also be attached to departure-side lip 8, as shown in FIG. 3.

The geometric conditions correspond then to those in FIG. 2. The advantage of the variant, among others, is that in cleaning the applicator 2 the guide element 40 can be cleaned very easily with front wall 22 and lip 8 turned down.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for one of direct and indirect application of a coating medium onto a traveling fiber material web having a width, said applicator comprising:

an approach-side lip having a first end associated with the web and extending substantially over the width of the web;

a departure-side lip having a second end associated with the web, said second end of said departure-side lip extending substantially over the width of the web and substantially parallel to said first end of said approach-side lip, said departure-side lip disposed after said approach-side lip relative to a direction of web travel, said approach-side lip and said departure-side lip defining a metering slot therebetween, said metering slot being configured as an open-jet nozzle;

an angled flow guide element separate from and attached to said departure-side lip, said angled flow guide element being directed toward the fiber web and angled away from said metering slot, said angled flow guide element being configured for guiding the coating medium out of said metering slot; and at least one feed conduit in fluid communication with said metering slot and configured for feeding the coating medium to said metering slot.

2. The applicator according to claim 1, wherein said flow guide element has a first shank and a second shank, said second shank being angled relative to said first shank at an angle $\alpha$ of approximately between 10° and 70°.

3. The applicator according to claim 2, wherein said first shank and said second shank define a radius therebetween, said radius being less than 9 millimeters.

4. The applicator according to claim 1, wherein said metering slot is subdivided in comb fashion with a plurality of through slots configured for passing the coating medium.

5. The applicator according to claim 4, where at least one of said approach-side lip and said departure-side lip includes a subdivided slot profile defining said plurality of through slots, said through slots extending substantially parallel to a flow direction of the coating medium flowing in said at least one feed conduit.

6. The applicator according to claim 5, wherein said slot profile comprises a profile bar.

7. An applicator for one of direct and indirect application of a coating medium onto a traveling fiber material web having a width, said applicator comprising:

an approach-side lip having a first end associated with the web and extending substantially over the width of the web;

a departure-side lip having a second end associated with the web, said second end of said departure-side lip extending substantially over the width of the web and substantially parallel to said first end of said approach-side lip, said departure-side lip disposed after said approach-side lip relative to a direction of web travel said approach-side lip and said departure-side lip defining a metering slot therebetween, said metering slot being configured as an open-jet nozzle;

an angled flow guide element attached to one of said approach-side lip and said departure-side lip, said angled flow guide element being directed toward the fiber web and being configured for guiding the coating medium out of said metering slot, said flow guide element having a first shank and a second shank said second shank being angled relative to said first shank at an angle $\alpha$ of approximately between 10° and 70°, said first shank and said second shank defining a radius therebetween, said radius being approximately between 0.5 and 3 millimeters said second shank being configured for directing the coating medium directly onto the fiber web from said second shank; and at least one feed conduit in fluid communication with said metering slot and configured for feeding the coating medium to said metering slot.

8. The applicator according to claim 7, wherein said angled flow guide element is formed unitarily with at least one of said first end of said approach-side lip and said second end of said departure-side lip.

9. The applicator according to claim 7, wherein said angled flow guide element is attached to at least one of said first end of said approach-side lip and said second end of said departure-side lip.

* * * * *

UNITED STATES PATENT AND TRADEMARK OFFICE

CERTIFICATE OF CORRECTION

PATENT NO. : 6,063,193
DATED : May 16, 2000
INVENTOR(S) : Harald Hess, et al.

It is certified that error appears in the above-identified patent and that said Letters Patent is hereby corrected as shown below:

Column 3
Line 17, after comb-like, delete "like".

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*